United States Patent [19]

Adam

[11] 4,270,836

[45] Jun. 2, 1981

[54] HOLDER FOR ELECTRICAL COMPONENT

[75] Inventor: Manfred Adam, Witten, Fed. Rep. of Germany

[73] Assignee: Wickmann-Werke AG, Witten, Fed. Rep. of Germany

[21] Appl. No.: 44,027

[22] Filed: May 31, 1979

[30] Foreign Application Priority Data

Jun. 9, 1978 [DE] Fed. Rep. of Germany ..... 2825317

[51] Int. Cl.[3] ..... H01R 13/432

[52] U.S. Cl. ..... 339/213 R; 339/217 S; 339/252 F

[58] Field of Search ..... 339/217 S, 252 F, 253 F, 339/258 F, 259 F, 262 F, 213

[56] References Cited

U.S. PATENT DOCUMENTS

| | | | |
|---|---|---|---|
| 2,431,366 | 11/1947 | Buell | 339/217 S |
| 2,989,610 | 6/1961 | Linton | 339/258 F |
| 3,149,899 | 9/1964 | Johanson | 339/217 S |
| 3,813,637 | 5/1974 | Grebik et al. | 339/258 F |
| 3,854,788 | 12/1974 | Goodman | 339/217 S |

FOREIGN PATENT DOCUMENTS

| | | |
|---|---|---|
| 1400583 | 4/1965 | France . |
| 1588940 | 6/1974 | France . |

*Primary Examiner*—John McQuade

*Attorney, Agent, or Firm*—Robert E. Burns; Emmanuel J. Lobato; Bruce L. Adams

[57] ABSTRACT

An electrical component holder consists of a socket-like housing (3) formed near its bottom with an opening (2). A foot-contact for engagement by an end cap (6) of an electrical component is formed as a metal tongue (1) having a bent back springy contact arm (5). The foot-contact can be inserted into the housing through the opening (2) in a resiliently compressed state but is subsequently retained within the housing by the position adopted by the contact of (5) under its own resilience.

14 Claims, 5 Drawing Figures

HOLDER FOR ELECTRICAL COMPONENT

The invention refers to a holder for an electrical component such as a cartridge fuse, the holder comprising a socket-like housing of electrically insulating material which is arranged to be closed at its open top end by a cap and which has a springy foot-contact in the bottom of the socket.

A known fuse-holder of the aforesaid kind (West German Patent Specification No. 1,588,940) has, in the bottom end of its socket-like housing, a foot-contact consisting of two contacts arranged opposite one another and connected together, and from which a connector lug extends outwards through the bottom of the housing and the resilience of the foot-contact is achieved by a coil spring inserted and arranged in the space between the two contacts of the foot-contact. When a cartridge fuse is introduced into the housing and brought with its cap into engagement with the foot-contact under pressure, the inserted spring effects permanent contact between the contact caps of the cartridge fuse and the contacts of the holder which are associated with them. However the manufacture of a foot-contact made springy in this way causes relatively high production costs. The same problem follows in the case of the fuse-holder known from French Patent Specification No. 1400583, where likewise a coil spring is arranged at the bottom of the housing and acts at its free end on a contact plate which comes into engagement with the contact cap of a cartridge fuse.

The problem, therefore, exists of simplifying the production and assembly of the springy foot-contact.

This problem is solved in accordance with the invention by the fact that the foot-contact is formed as a metal tongue having a bent back springy contact arm, and is so constructed that, with the contact arm resiliently compressed against the tongue, the foot-contact can be inserted into the housing through an opening and secured therein by the contact arm springing back away from the tongue.

The manufacture of a foot-contact made in this way is extraordinarily simple because it is merely necessary to produce a metal tongue from which at least one spring contact arm is bent back so that it makes an acute angle with the metal tongue. Assembly too can be very simply performed since the foot-contact can be inserted through the opening in the housing with the contact arm pressed hard against the metal tongue. When the metal tongue is inserted far enough into the housing, the contact arm becomes free and can thus spring up in order to secure the foot-contact in the housing. The contact arm then acts as a stop against the inner wall of the housing. There is no need of any further separate spring device either in the bottom region of the housing, in the cartridge cap, or otherwise. Satisfactory contact is made by the spring action of the contact arm both between the foot-contact and the corresponding contact cap of the electrical component and also between the housing contact and the second contact cap. As compared with previous constructions, one of the otherwise usual contact resistances in the circuit is eliminated. The structural length of the fuse-holder can be shortened because of the new construction of the foot-contact. Drilling of the usual holes for the foot-contact is eliminated and furthermore, a saving of material is realized. Outlay on testing the housing is reduced since the metal tongue cannot damage the housing and can guarantee a high degree of safety in service. Also much of the outlay on testing of the cap, for example, is reduced when the necessary spring action is generated by the foot-contact. In the case of indicator-pin caps, no trouble arises upon the release of the fuse by the compression spring.

The contact arm advantageously has at its free end a part which is bent down in the direction towards the metal tongue and bears against the inside of the housing. When the contact arm is moved, the bent down part can slide against an inner wall of the housing. Security against unintentional sliding of the foot contact out of the housing is improved by the bent down part.

Although it is possible to introduce the foot-contact through an opening in the bottom of the housing, an opening in the side of the housing may be preferred. In the latter case, a stop-part may be bent outwards from the bent down part to catch underneath the top edge of the opening when the contact arm springs freely upwards in the housing. In this way the position of the contact arm is secured in the housing in the unstressed state.

A very important advantage is achieved if the free end of the contact arm, because of appropriate dimensioning of its maximum spring travel, cannot be moved far enough to be in alignment with the top of the opening. Otherwise under unfavourable conditions the foot-contact could slide out of the opening if the contact arm were forced back in use by the electrical component and simultaneously a pull were exerted on the external connector lug of the foot-contact. In the case of the construction which includes a bent down part and in addition a stop-part bent outwards, an appropriate dimensioning of the maximum spring travel of this component is likewise effected in relation to the position and size of the opening.

In order to enable there to be as large an area of engagement between the contact cap of the electrical component and the foot-contact as possible, the width of the part of the contact arm intended for engagement with the contact cap of the electrical component is preferably greater than that of the other parts and it may exhibit an approximately circular shape in outline.

For securing the foot-contact at the bottom or at least in the lower part of the housing, the metal tongue of the foot-contact advantageously has at least one leg which, upon insertion of the metal tongue, runs into at least one groove extending in the direction of insertion on the inside of the housing. Preferably the metal tongue is bounded on each side by such a leg, the edge of which in each case engages in a respective one of two grooves lying opposite one another in the housing.

The end of the metal tongue remote from the contact arm is advantageously made as a connector lug.

A particularly simple manufacture of the foot-contact results if the metal tongue is punched in one piece out of sheet metal and is produced ready for use by bending its associated parts such as the contact arm. The advantages which can be achieved by doing this become clearer during the course of the later description of a preferred example incorporating the invention. Advantageously the punched sheet metal part of the metal tongue exhibits two cuts running in the longitudinal direction for separating two legs from a central arm to which the contact arm is connected.

Two examples of holders constructed in accordance with the invention are illustrated in the accompanying drawings, in which.

Figure 1:
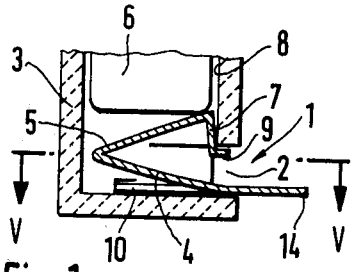
FIG. 1 is a sectional elevation of part of a housing of a cartridge fuse with a foot-contact inserted.
Figure 3:
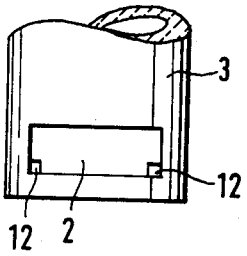
FIG. 3 is a side elevation of part of a housing showing an opening for the insertion of the foot-contact.
Figure 5:
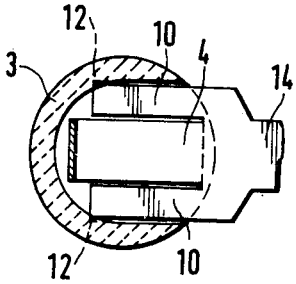
FIG. 5 is a section taken on the line V—V in FIG. 1.

In FIG. 1 a resilient contact member in the form of a metal tongue designated in general by 1 is inserted as a foot-contact through an opening 2 in the housing 3 of a fuse-holder and anchored there as explained later. A central arm portion 4 forms the metal tongue proper and continues into a springy contact arm 5 portion which is bent back from the central arm 4 to form a resilient bent back portion which is configured for resilient engagement with a contact cap 6 of a cartridge fuse. As shown in FIG. 1, the bent back portion exerts an upward axial force on the cartridge fuse urging the fuse toward the top end of the housing 3 and the resiliency of the bent back portion is sufficient to ensure good electrical connection between the fuse and metal tongue 1. From the free end of the contact arm 5 a part 7 is bent down in the direction towards the metal tongue 1 and lies in the direct neighbourhood of the inside 8 of the housing. A stop-part 9 bent outwards from the part 7 catches underneath the top edge of the opening 2 when the contact arm 5 is not loaded by the contact cap 6 of the cartridge. Legs 10 extend in the longitudinal direction on both sides of the central arm 4 and engage in recesses or grooves 12 on the inside of the housing 3. In this way, firm anchoring in a predetermined position in the housing 3 is imparted to the foot-contact. At the other end of the metal tongue 1 (on the right in FIG. 1 but not completely shown) is an external connector lug 14 for connection to other circuitry.

The maximum spring travel of the contact arm 5 is so chosen that the top end of the contact arm 5 or respectively of the part 7 cannot get under the edge of the opening 2, in order to prevent an unintentional slipping-out or withdrawal of the foot-contact if this is loaded in tension from outside. On the contrary, the central arm 4 and the contact arm 5 get forced hard against the other parts of the metal tongue 1 when upon assembly of the foot-contact the metal tongue 1 is being inserted through the opening 2 into the housing 3. Upon insertion into the opening 2, the springy compressed state of the metal tongue 1 is maintained automatically but the parts relax and flex back from one another and adopt the position shown in FIG. 1 as soon as the contact arm 5 has passed completely through the opening 2.

Figure 2:
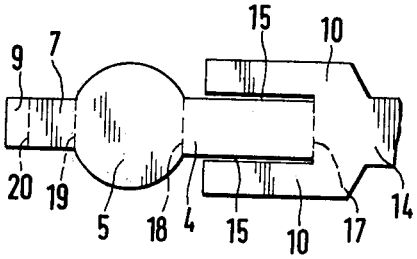
FIG. 2 is a plan of a punched sheet metal part with bending lines marked for making the foot-contact which can be seen from FIG. 1.

FIG. 2 shows a punched sheet metal part from which the metal tongue 1 can be produced by appropriate bending up or down respectively of the individual parts. Cuts or slits 15 separate the legs 10 from the central arm 4. For the rest, bending lines 17, 18, 19, 20 are marked which bound the individual parts as may be seen from FIG. 1.

Figure 4:
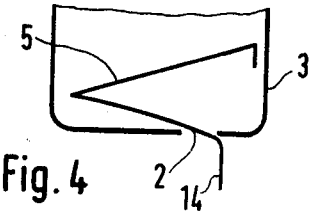
FIG. 4 is a diagrammatic illustration of a housing with a foot-contact which can be inserted through an opening in the bottom of the housing.

In FIG. 4 it is merely indicated diagrammatically that the invention can also be applied to a construction in which the opening 2 is arranged in the bottom of the housing 3. Preferably, however, an opening 2 made in the side of the housing 3 in accordance with FIG. 1 is made use of.

The invention is also applicable to holders for other electrical components too, such as incandescent or glow lamps, thermal trips or the like, where axial springing is needed.

I claim:

1. In a holder for holding an electrical component of the type having a socket-like housing of electrically insulating material adapted to be closed at its top end by a cap and having a springy foot-contact in the bottom thereof, the improvement wherein said foot-contact comprises a one-piece sheet metal tongue having two slits running in the longitudinal direction thereof dividing said tongue into a central arm and two legs one on either side of said central arm, and having a bent back springy contact arm connected to said central arm, and said housing has means defining an opening therein, said foot-contact being so constructed that, with said contact arm resiliently compressed toward said central arm, said foot-contact can be inserted into said housing through said opening and secured in said housing by said contact arm springing back away from said central arm.

2. A holder according to claim 1, wherein said contact arm has at its free end a part which is bent down in the direction towards said metal tongue and bears against an inner wall of said housing to secure said foot-contact in said housing.

3. A holder according to claim 2, wherein said opening is in a side of said housing and said foot-contact has a stop-part bent outwards from said bent down part, said stop-part being configured to catch beneath an upper edge of said opening when said contact arm springs upwards after insertion of said foot-contact through said opening.

4. A holder according to claim 1, wherein the maximum spring travel of said contact arm as a result of pressure from said electrical component, in use, is insufficient to enable said foot-contact to be pulled back through said opening.

5. A holder according to claim 1, wherein the width of a part of said contact arm intended for engagement with a contact of said electrical component is greater than that of the rest of said contact arm and has a substantially circular shape.

6. A holder according to claim 1, wherein two grooves are provided within said housing extending in the direction of insertion of said foot-contact through said opening so that upon insertion of said metal tongue through said opening said two legs run into respective ones of said grooves.

7. A holder according to claim 1, wherein an end of said metal tongue remote from said contact arm is formed as a connector lug.

8. In a holder for holding an electrical component such as a fuse or the like and comprised of a socket-like housing having an open top end for receiving therethrough the electrical component and having at its bottom end a resilient contact for electrically connecting the electrical component to other circuitry during use of the holder; the improvement wherein said housing has means therein defining an opening in the region of the housing bottom end; and wherein said resilient contact comprises a sheet metal contact member having a resilient bent back portion configured to be resiliently compressed and inserted through said opening and having sufficient resiliency to flex back after insertion through said opening so as to both prevent withdrawal thereof through said opening and to resiliently urge the electrical component axially toward the housing top end with sufficient force to ensure electrical connection between said resilient contact and the electrical component.

9. A holder according to claim 8; wherein said opening is located in the side of said housing adjacent the housing bottom end.

10. A holder according to claim 8; wherein said opening is located in the housing bottom end.

11. A holder according to claim 8; wherein said resilient contact member includes means coacting with said housing for anchoring said contact member to said housing in a predetermined position.

12. A holder according to claim 11; wherein said means for anchoring comprises at least one leg portion extending from said contact member in the direction of insertion thereof in said opening, and at least one groove in said housing dimensioned to receive therein said leg portion during insertion of said contact member in said opening thereby anchoring said contact member in said predetermined position.

13. A holder according to claim 8; wherein said contact member includes a central arm portion having connected thereto and extending therefrom a contact arm portion, said contact arm portion being bent back towards said central arm portion of define said resilient bent back portion.

14. A holder according to claim 13; wherein said contact member further includes another bent portion connected to and extending from said contact arm portion, said another bent portion being bent so as to resiliently engage the wall of said housing to assist in securing said contact member to said housing.

* * * * *